US006268688B1

(12) United States Patent
Tani et al.

(10) Patent No.: US 6,268,688 B1
(45) Date of Patent: Jul. 31, 2001

(54) COLOR CATHODE RAY TUBE

(75) Inventors: Munechika Tani; Takashi Murai, both of Fukaya; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/420,943

(22) Filed: Oct. 19, 1999

(30) Foreign Application Priority Data

Oct. 20, 1998 (JP) ..... 10-298000

(51) Int. Cl.[7] ..... H01J 29/07
(52) U.S. Cl. ..... 313/402; 313/407
(58) Field of Search ..... 313/402, 403, 313/404, 407, 408

(56) References Cited

U.S. PATENT DOCUMENTS 5,689,150 * 11/1997 Ragland, Jr. ..... 313/407 X
6,188,169 * 2/2001 Takayanagi ..... 313/402 X
6,188,170 * 2/2001 Shimizu et al. ..... 313/407

FOREIGN PATENT DOCUMENTS 10-79233 3/1998 (JP) .

* cited by examiner

*Primary Examiner*—Ashok Patel
(74) *Attorney, Agent, or Firm*—Oblon, Spivak, McClelland, Maier & Neustadt, P.C.

(57) ABSTRACT

A substantially rectangular shadow mask is arranged opposite to a phosphor screen formed on an inner surface of a panel. The shadow mask has a mask body and a mask frame to which a peripheral portion of the mask body is attached. The shadow mask has a rectangular form having a center through which a tube axis passes, and a long axis and a short axis passing through the center and perpendicular to each other. The mask frame has a pair of long side walls extending parallel to the long axis and a pair of short side walls extending parallel to the short axis. The height of each long side wall at a central portion along the tube axis is lower than the height of each short side wall at a central portion along the tube axis.

8 Claims, 3 Drawing Sheets

COLOR CATHODE RAY TUBE

BACKGROUND OF THE INVENTION

The present invention relates to a color cathode ray tube having a shadow mask.

In general, a color cathode ray tube has an envelope. The envelope comprises a substantially rectangular panel having an effective portion constituted by a curved surface and a skirt portion provided on the circumference of the effective portion. It also comprises a funnel connected to the skirt portion. A phosphor screen is formed on the inner surface of the effective portion of the panel. The phosphor screen comprises light absorbing layers and phosphor layers of three colors buried in gaps between the light absorbing layers. A substantially rectangular shadow mask is arranged at a predetermined distance from the phosphor screen. An electron gun is mounted in a neck portion of the funnel.

Three electron beams emitted from the electron gun are deflected by a deflector mounted on the outer surface of the funnel, and scan the phosphor screen in the horizontal and vertical directions via the shadow mask, so that a color image is displayed.

The shadow mask comprises a rectangular mask body and a substantially rectangular mask frame to which a skirt portion of the mask body is attached. The mask body has a main surface constituted by a curved surface opposing to the phosphor screen and the skirt portion provided on the circumference of the main surface. The main surface has a number of electron beams passing apertures. The shadow mask is arranged inside the panel by engaging elastic supporting members attached to the mask frame with stud pins attached to the panel.

The side wall portion of the mask frame is parallel with the tube axis (the Z-axis) of the cathode ray tube and in contact with the skirt portion of the mask body. The edge of the side wall portion on the side of the phosphor screen has a shape corresponding to the curve of the circumference of the main surface of the mask body.

In the general shadow mask in which the main surface of the mask body opposing to the phosphor screen has curvatures in the directions of the long and short axes, a fall of the main surface, along the tube axis, at each end of a diagonal axis relative to the center of the mask body is greater than those at the ends of the long axis and the short axis of the main surface. Accordingly, the height of the side wall portion of the mask frame is lower at the ends of the diagonal axis than those at the ends of the long axis and the short axis.

A recent color cathode ray tube has a large size and the screen thereof is long sideways to have an aspect ratio of 16:9. In this type of color cathode ray tube, the main surface of the mask body has a large area. Further, to improve the visibility, the radius of curvature of the outer surface of the effective portion of the panel has been extended substantially infinitely large to flatten the panel. In this type of color cathode ray tube, the main surface of the mask body must also be flattened. In this case, the fall of the circumference of the main surface relative to the center of the mask body is small. Therefore, the mechanical strength of the shadow mask of the color cathode ray tube is low.

Generally, in the shadow mask, the mask frame has a greater thickness and a greater heat capacity as compared to the mask body. Particularly in a color cathode ray tube of large size, the mask frame must be thick to increase the mechanical strength of the shadow mask. Therefore, the difference in heat capacity between the mask body and the mask frame is much greater. In this case, the beam landing is deviated due to the difference in heat capacity, resulting in degradation of color purity.

The mask body is heated by impingement of electron beams, when the color cathode ray tube is operated. Since the heat generated in the mask body is transmitted to the mask frame via a contact portion therebetween, the temperature of the peripheral portion of the mask body is lower than that of the central portion thereof. Therefore, when the color cathode ray tube is operated, the central portion of the mask body is deformed more greatly as compared to the peripheral portion thereof. As a result, the electron beam landing on the phosphor layers of the three colors is displaced, so that the color purity is degraded.

Further, as multimedia applications have been developed, the arrangement pitch of the three-color phosphor layers in a color display tube used in a computer terminal or the like has become smaller than that of the ordinary color cathode ray tube. In this case, the margin of beam landing is small and color deviation easily occurs. For this reason, the beam landing is required to be more accurate in the color display tube.

Actually, the position of the shadow mask relative to the panel may be shifted due to shock which the color cathode ray tube receives in a manufacturing process or transport. Particularly in a large color cathode ray tube or a color cathode ray tube having the aspect ratio of 16:9, since the shadow mask is comparatively heavy, the position of the shadow mask relative to the panel is easily shifted due to shock in a manufacturing process or transport of the color cathode ray tube.

Further, in a large color cathode ray tube or a color cathode ray tube having the aspect ratio of 16:9, if the thickness of the mask frame is increased to mechanically strengthen the shadow mask, load on the elastic supporting members supporting the shadow mask is increased due to the increase in weight of the shadow mask. In this case, if the shock resistance is improved by, for example, increasing the elasticity of the elastic supporting members, in order to prevent the shadow mask from positional deviation due to shock, the mask frame may be deformed by force applied thereto when the shadow mask is attached to and detached from the panel. As a result, the position of the shadow mask relative to the panel is shifted.

The problem described above is particularly remarkable in the case of a color cathode ray tube with a flat panel in which the radius of curvature of the outer surface of the effective portion is substantially infinite.

BRIEF SUMMARY OF THE INVENTION

The present invention was made to solve the aforementioned problem. It is accordingly an object of the present invention to provide a color cathode ray tube which can suppress the increase in difference in heat capacity between the mask body and the mask frame and the increase in weight of the mask frame, and prevent the beam landing from deviating when the shadow mask receives shock.

To achieve the above object, a color cathode ray tube of the present invention comprises:

- an envelope including a panel having a substantially rectangular effective portion;
- a phosphor screen provided on an inner surface of the effective portion;
- a substantially rectangular shadow mask arranged opposite to the phosphor screen in the envelope, the shadow mask having a center through which a tube axis passes, and a long axis and a short axis passing through the center and perpendicular to each other; and an electron gun for emitting electron beams to the phosphor screen through the shadow mask.

The shadow mask includes: a substantially rectangular mask body having a main surface which is constituted by a curved surface opposite to the phosphor screen and in which a number of electron beams passage apertures are formed; and a substantially rectangular mask frame to which a peripheral portion of the mask body is attached, the mask frame having a substantially rectangular side wall portion parallel to the tube axis, and a height of the side wall portion along the tube axis at ends of the short axis being lower than a height of the side wall portion along the tube axis at ends of the long axis.

In the color cathode ray tube of the present invention, the height of the side wall portion along the tube axis at ends of the short axis is lower than the height of the side wall portion along the tube axis at the ends of the long axis and a height of the side wall portion along the tube axis at ends of a diagonal axis of the shadow mask.

Further, in the color cathode ray tube of the present invention, the height of the side wall portion along the tube axis at the ends of the short axis is substantially the same as the height of the side wall portion along the tube axis at ends of a diagonal axis of the shadow mask.

Furthermore, in the color cathode ray tube of the present invention, the side wall portion of the shadow mask has a pair of long side walls extending parallel to the long axis and a pair of short side walls extending parallel to the short axis, a height of each short side wall at a central portion along the tube axis being higher than those at both end portions thereof, and a height of each long side wall at a central portion along the tube axis being lower than the height of each short side wall at the central portion along the tube axis. The height of each long side wall over at least 80% of a length thereof is the same as the height of the long side wall at the central portion along the tube axis.

With the color cathode ray tube as described above, the height of the mask frame at the ends of the short axis is lower than the other portions. As a result, the heat capacity and the weight of the mask frame can be smaller than those of the conventional mask frame. Therefore, even when the mask body is heated by impingement of the electron beams, the difference in temperature between the central portion and the peripheral portion of the mask body is reduced. Accordingly, the deviation of the electron beam landing due to the deformation of the central portion of the mask body can be reduced. Even if the shadow mask receives shock in a manufacturing process or transport of the color cathode ray tube, the positional deviation of the shadow mask relative to the panel can be suppressed. As a result, the deviation of the electron beam landing due to the shock can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the prefer embodiments given below, serve to explain the principles of the invention.

FIGS. 1 to 6 show a color cathode ray tube according to an embodiment of the present invention, in which:

FIG. 1 is a cross-sectional view of the color cathode ray tube,

FIG. 2 is a schematic perspective view showing portions of the electron gun, the shadow mask and the phosphor screen of the color cathode ray tube, FIG. 4 is a perspective view of the mask frame of the shadow mask, FIG. 5 is a diagram showing notches formed to prevent a cut due to drawing which is performed when the mask body of the shadow mask is formed, and FIG. 6 is a perspective view showing the relationship between the notches and the mask frame.

DETAILED DESCRIPTION OF THE INVENTION

Embodiments of the color cathode ray tube of the present invention will be described in detail with reference to the accompanying drawings.

Figure 1:
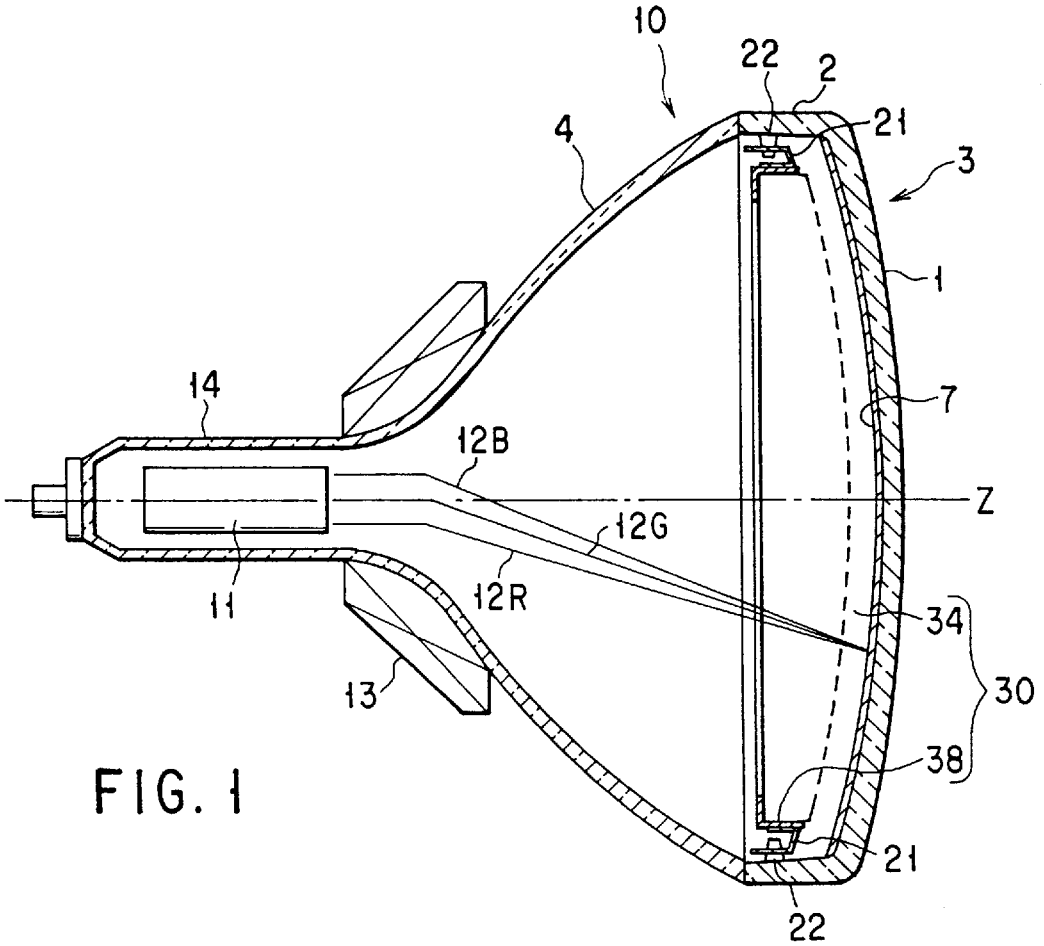

As shown in FIG. 1, the color cathode ray tube comprises a vacuum envelope 10. The vacuum envelope includes a substantially rectangular panel 3 and a funnel 4. The panel 3 has an effective portion 1 constituted by a curved surface and a skirt portion 2 provided on the circumference of the effective portion, which are formed integral with each other. The funnel 4 is attached to the skirt portion 2.

Figure 2:
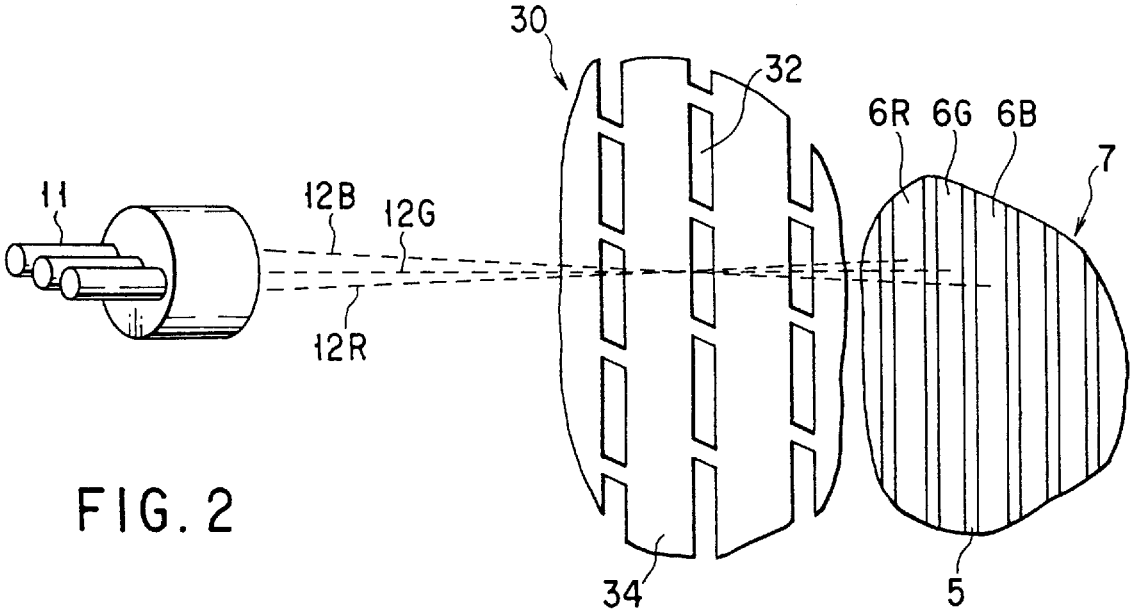
Figure 3A:
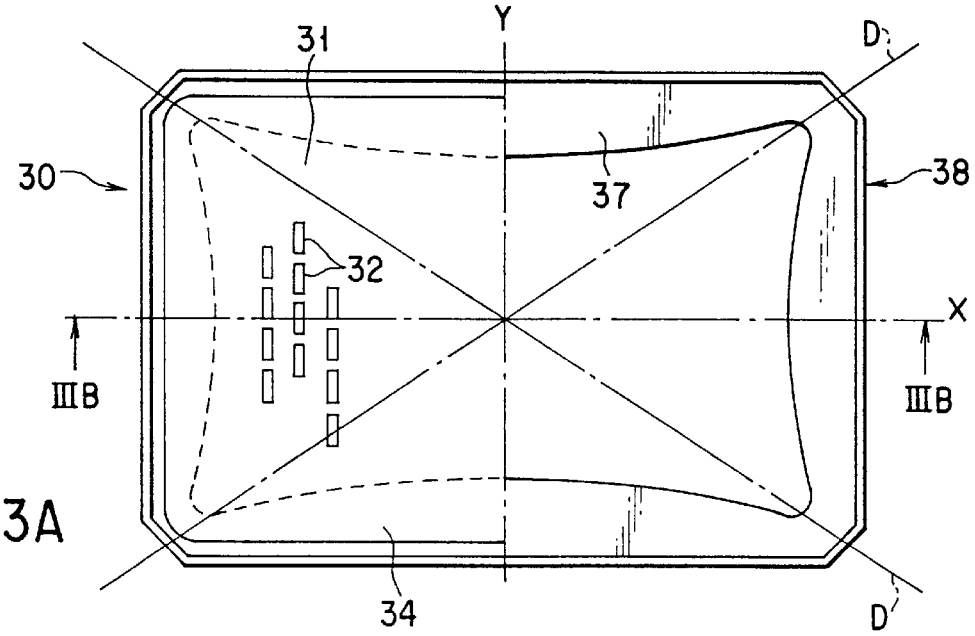
FIG. 3A is a plan view of the shadow mask.
Figure 3B:
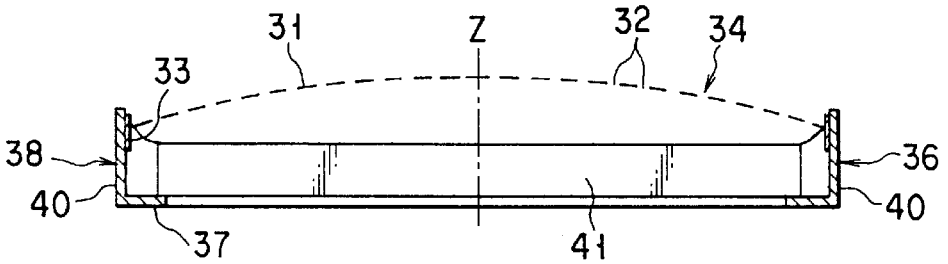
FIG. 3B is a cross-sectional view taken along the line IIIB—IIIB in FIG. 3A.
Figure 4:
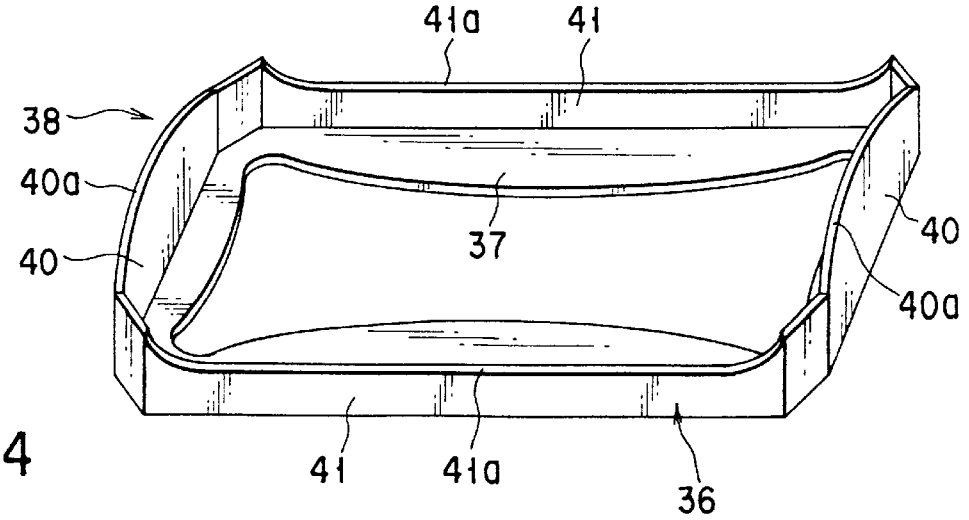
Figure 5:
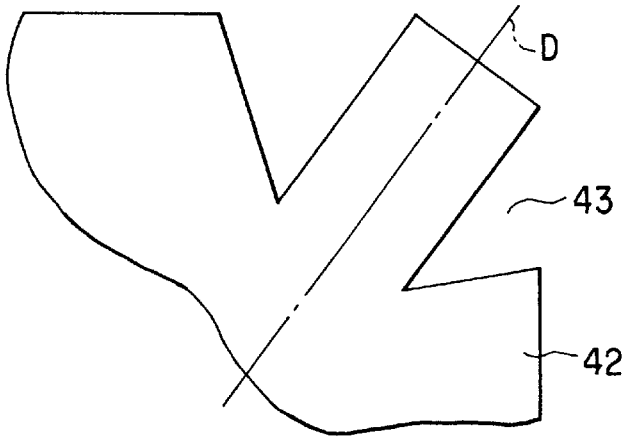

As shown in FIGS. 1 and 2, a phosphor screen 7 is formed on the inner surface of the effective portion 1 of the panel 3. The phosphor screen 7 comprises light absorbing layers 5 and strip shaped phosphor layers 6R, 6G and 6B of three colors buried in gaps between the light absorbing layers.

In the vacuum envelope 10, a substantially rectangular shadow mask 30 is arranged at a predetermined distance from the phosphor screen 7. The shadow mask 30 is supported inside the panel 3 by engaging wedge-shaped elastic supporting members 21 attached to a mask frame (described later) with stud pins 22 attached to corner portions of the skirt portion 2 of the panel 3.

An electron gun 11 is arranged in a neck portion 14 of the funnel 4. A deflector 13 is mounted on the outer surface of the funnel 4. In the color cathode ray tube, three electron beams 12B, 12G and 12R emitted from the electron gun 11 are deflected by the deflector 13, and scan the phosphor screen 7 in the horizontal and vertical directions through the shadow mask 30. Thus, the color cathode ray tube displays a color image.

As shown in FIGS. 1 to 4, the shadow mask 30 comprises a substantially rectangular mask body 34 and a substantially rectangular mask frame 38 to which a skirt portion 33 of the mask body is attached. The mask body 34 has a main surface 31 constituted by a curved surface opposing to the phosphor screen 7 and the skirt portion 33 provided on the circumference of the main surface. The main surface 31 has a number of electron beams passage apertures 32. The main surface 31 of the mask body 34 has a center O through which a tube axis Z passes, and a long axis X and a short axis Y, passing through the center O and perpendicular to each other.

The substantially rectangular mask frame 38 has a side wall portion 36 having a pair of short side walls 40 opposing to each other and a pair of long side walls 41 opposing to each other. The long side walls 41 extend parallel to the long axis X and the short side walls 40 extend parallel to the short axis Y. The short side walls 40 and the long side walls 41 are parallel to the tube axis Z. An inward protrusion 37 is protruded from the edge of the side walls on the side of the electron gun 11 in the direction perpendicular to the tube axis Z. The skirt portion 33 of the mask body 34 is welded to the inner surfaces of the edge portions of the short side walls 40 and the long side walls 41 on the side of the phosphor screen 7.

Edges 40*a* of the short side walls 40 on the side of the phosphor screen 7 are arc-shaped so as to correspond to the shape of the main surface 31 of the mask body 34 at both ends of the long axis, i.e., the shape of the short sides of the main surface 31. Therefore, each short side wall 40 is higher at a central portion thereof than at the ends of the side wall portion 36, i.e., at the ends of diagonal axes D.

On the other hand, over 80% of the length of each long side wall 41 except both end portions thereof, the edge of the long side wall 41 on the side of the phosphor screen 7 is cut off. Therefore, the edges of the long side walls 41 on the side of the phosphor screen 7 are recessed with respect to the phosphor screen 7. In other words, they have a shape different from the side of the main surface 31 of the mask body 31 at each end of the short axis, i.e., the long side of the main surface 31. Thus, each long side wall 41 is lower in a central portion than in end portions, near the ends of the diagonal axes D of the side wall portion 36. Consequently, the side wall 36 of the mask frame 38 is lower at the ends of the short axis Y than at the ends of the long axis X and the ends of the diagonal axis D.

According to the color cathode ray tube described above, the height of the central portion of the long side wall 41 of the mask frame 38 is lower than the end portions thereof. As a result, the heat capacity of the mask frame 38 can be about 3% smaller than that of the conventional mask frame in which the shape of the edge of the side wall portion on the side of the phosphor screen coincides with that of the circumference of the main surface of the mask body. Therefore, even when the mask body 34 is heated by impingement of the electron beams 12B, 12G and 12R, the difference in temperature between the peripheral portion of the mask body 34 in contact with the side wall 36 of the mask frame 38 and the central portion of the mask body 34 is reduced. Accordingly, when the color cathode ray tube is operated, the deformation of the central portion of the mask body 34 can be reduced, and the deviation of the electron beams landing on the phosphor screen 7 can also be reduced.

Further, if the height of the side wall portion 36 of the mask frame 38 at the ends of the short axis Y is lower, the weight of the mask frame 38 can be about 3% smaller than that of the conventional mask frame. Thus, even if the shadow mask 30 receives shock in a manufacturing process or transport of the color cathode ray tube, the positional deviation of the shadow mask 30 relative to the panel 3 can be suppressed.

Furthermore, if the shadow mask 30 of the above structure is applied to the color cathode ray tube having the flattened panel 3 in which the outer surface of the effective portion 1 of the panel 3 has a substantially infinitely large radius of curvature, deterioration of the mechanical strength of the shadow mask 30 can be suppressed.

More specifically, in the color cathode ray tube having the flattened panel 3 in which the outer surface of the effective portion 1 has a substantially infinitely large radius of curvature, the main surface 31 of the mask body 34 of the shadow mask 30 is also flattened. To increase the mechanical strength of the flat shadow mask 30, it is effective to make the curvature along the short axis Y of the mask body 34 greater than that along the long axis X. This is because, if the fall of the main surface 31 along the tube axis Z relative to the center O of the mask body 34 at the ends of the long axis X is the same as that at the ends of the short axis Y, the curvature along the short axis is greater than that along the long axis. In this case, the mechanical strength of the shadow mask 30 tends to depend on the curvature along the short axis Y.

In other words, if the fall of the main surface 31 along the tube axis Z relative to the center O of the mask body 34 at the ends of the long axis X is the same as that at the ends of the short axis Y, the curvature along the short axis Y contributes to the mechanical strength of the shadow mask 30 more greatly than that along the long axis X. For this reason, in the color cathode ray tube having the flattened panel 3 in which the outer surface of the effective portion 1 has a substantially infinitely large radius of curvature, the fall of the main surface 31 at the ends of the long axis X is reduced by increasing the curvature of the mask body 34 along the short axis Y and decreasing the curvature thereof along the long axis X. Thus, the mechanical strength of the shadow mask 30 can be increased by increasing the curvature along the short axis Y.

Consequently, as regards the shadow mask of a color cathode ray tube having a flat panel as described above, it is preferable that the fall of the main surface 31 relative to the center O of the mask body 34 at the ends of the short axis be substantially the same as that at the ends of the diagonal axis, and the fall of the main surface 31 at the ends of the long axis X be small. It is also preferable that the curvature along the long axis X at the ends of the long axis be as great as possible and the curvature along the short axis Y at the ends of the long axis be also great. With this structure, it is possible to prevent deterioration of the mechanical strength of the shadow mask.

Figure 6:
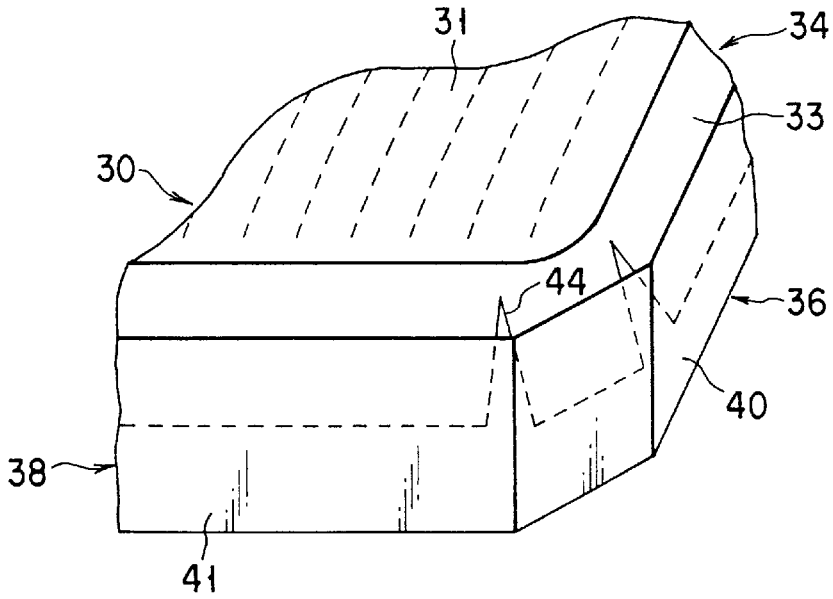

The mask body 34 is formed by drawing a flat mask in which electron beams passage apertures 32 are formed. For this reason, each corner portion of the flat mask 42 has notches 43 to prevent a cut or a crease from occurring by the drawing process. The possibility of cut is lowered by deepening the notches 43. However, as shown in FIG. 6, if the notches 43 are too deep, exposure portions 44 of the notches 43, which are not covered by the side wall 36 of the mask frame 34, may be defined, when the shadow mask 30 is assembled. In this case, upon forming the phosphor screen 7, a phosphor layer corresponding to the exposure portions 44 is deposited on the inner surface of the panel 3. When the color cathode ray tube is operated, the phosphor layer is excited by the electron beams passed through the exposure portions 44, and emits unnecessarily.

However, according to the present invention, in the shadow mask 30 described above, the fall of the peripheral portion of the main surface 31 relative to the center O of the mask body 34 is small. In addition, the side wall portion 36 of the mask frame 38, which is coupled with the mask body, is higher in a portion near the end of the diagonal axis D than at the end of the short axis Y. With this structure, the exposure portions 44 formed by the cuts are covered by the mask frame 38. As a result, unnecessary emission is prevented.

Therefore, the color cathode ray tube having the structure as described above suppresses deviation of the beam landing due to a difference in heat capacity between the mask body 34 and the mask frame 38 of the shadow mask 30. Further, since the weight of the shadow mask 30 is reduced, even if the color cathode ray tube receives shock in a manufacturing process or transport, the position of the shadow mask relative to the panel 1 cannot be shifted. As a result, the deviation of the beam landing due to shock or the like can be reduced. Moreover, when the present invention is applied to a color cathode ray tube with a flat panel in which the outer surface of the effective portion of the panel has a substantially infinitely large radius of curvature, the mechanical strength of the shadow mask can be satisfactorily maintained. Therefore, it is possible to provide a color cathode ray tube with a high quality in which the deviation of the beam landing due to deformation of the shadow mask is suppressed and unnecessary emission does not occur.

Figure 7:
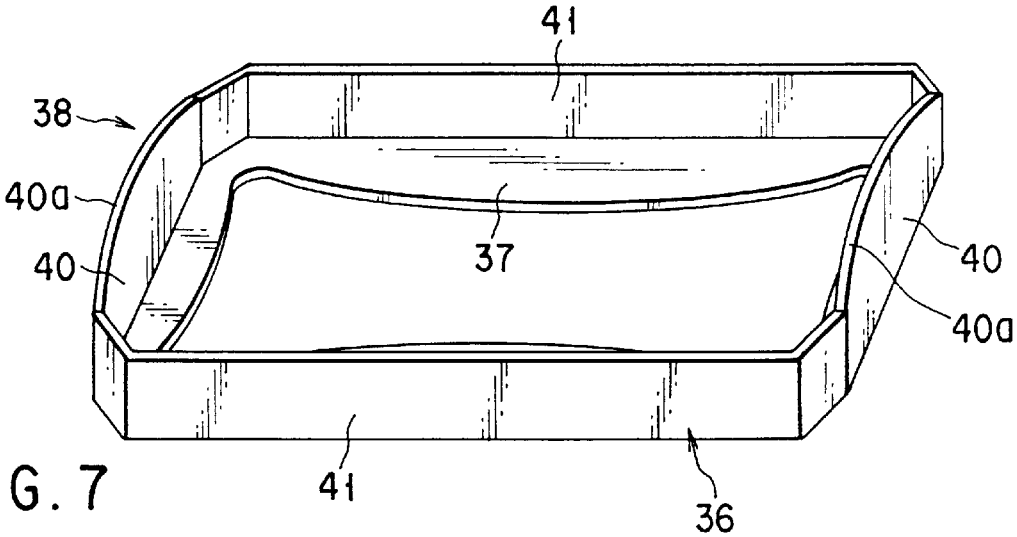
FIG. 7 is a perspective view of a mask frame according to another embodiment of the present invention.

The present invention is not limited to the above embodiment but can be modified variously within the scope of the invention. According to the above embodiment, the side wall is higher at the ends of the short axis of the mask frame than at the ends of the long axis and the diagonal axis. However, as shown in FIG. 7, the height of the side wall 36 at the ends of the short axis of the mask frame 38 may be substantially the same as that at the ends of the diagonal axis, while those heights are lower than the height of the side wall at the ends of the long axis. In this case also, the same effect as that of the above embodiment can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a panel having a substantially rectangular effective portion;

a phosphor screen provided on an inner surface of the effective portion;

a substantially rectangular shadow mask arranged opposite to the phosphor screen in the envelope, the shadow mask having a center through which a tube axis passes, and a long axis and a short axis passing through the center and perpendicular to each other; and an electron gun for emitting electron beams to the phosphor screen through the shadow mask, the shadow mask including: a substantially rectangular mask body having a main surface which is constituted by a curved surface opposite to the phosphor screen and in which a number of electron beams passage apertures are formed; and a substantially rectangular mask frame to which a peripheral portion of the mask body is attached, the mask frame having a substantially rectangular side wall portion parallel to the tube axis, and a height of the side wall portion along the tube axis at ends of the short axis being lower than a height of the side wall portion along the tube axis at ends of the long axis.

2. A color cathode ray tube according to claim 1, wherein the height of the side wall portion along the tube axis at the ends of the short axis is lower than the height of the side wall portion along the tube axis at the ends of the long axis and a height of the side wall portion along the tube axis at ends of a diagonal axis of the shadow mask.

3. A color cathode ray tube according to claim 1, wherein the height of the side wall portion along the tube axis at the ends of the short axis is substantially the same as the height of the side wall portion along the tube axis at ends of a diagonal axis of the shadow mask.

4. A color cathode ray tube according to claim 1, wherein the side wall portion of the shadow mask has a pair of long side walls extending parallel to the long axis and a pair of short side walls extending parallel to the short axis, a height of each short side wall at a central portion along the tube axis being higher than those at both end portions of the short side wall, and a height of each long side wall at a central portion along the tube axis being lower than the height of each short side wall at the central portion along the tube axis.

5. A color cathode ray tube according to claim 4, wherein a height of each long side wall over at least 80% of a length thereof is the same as the height of the long side wall at the central portion along the tube axis.

6. A color cathode ray tube according to claim 4, wherein each short side wall has an arc-shaped edge projecting toward the phosphor screen.

7. A color cathode ray tube according to claim 1, wherein the panel has an outer surface having a substantially infinitely large radius of curvature.

8. A color cathode ray tube according to claim 1, wherein a curvature of the main surface of the mask body along the short axis is greater than that along the long axis.

* * * * *